US005465855A

United States Patent [19]

Erdmann

[11] Patent Number: 5,465,855

[45] Date of Patent: Nov. 14, 1995

[54] TELESCOPING CRANE ARM

[75] Inventor: Gerd Erdmann, Oldenburg, Germany

[73] Assignee: Fried. Krupp AG Hoesch-Krupp, Essen, Germany

[21] Appl. No.: 226,074

[22] Filed: Apr. 11, 1994

[30] Foreign Application Priority Data

Apr. 10, 1993 [DE] Germany ..... 43 11 964.6

[51] Int. Cl.[6] ..... B66C 23/04

[52] U.S. Cl. ..... 212/349

[58] Field of Search ..... 212/268, 231, 212/230, 264

[56] References Cited

U.S. PATENT DOCUMENTS

| | | | |
|---|---|---|---|
| 3,809,249 | 5/1974 | Grove | 212/268 |
| 4,156,331 | 5/1979 | Lester et al. | 212/268 |
| 4,327,533 | 5/1982 | Sterner | 212/268 |
| 4,406,375 | 9/1983 | Hockensmith | 212/268 |
| 4,490,951 | 1/1985 | Mentzer et al. | 212/268 |

FOREIGN PATENT DOCUMENTS

| | | |
|---|---|---|
| 0446115 | 9/1991 | European Pat. Off. . |
| 2681649 | 3/1993 | France . |
| 7015460 | 8/1970 | Germany . |
| 2046652 | 4/1971 | Germany . |
| 4131751 | 3/1993 | Germany . |
| 1463707 | 3/1989 | U.S.S.R. . |
| 1685859 | 10/1991 | U.S.S.R. . |
| 1728123 | 4/1992 | U.S.S.R. . |
| 86/00607 | 1/1986 | WIPO . |

*Primary Examiner*—Andres Kashnikow
*Assistant Examiner*—Thomas J. Brahan
*Attorney, Agent, or Firm*—Spencer, Frank & Schneider

[57] ABSTRACT

A telescoping crane arm assembly includes a base body; a power cylinder extendable from and retractable into the base body; a plurality of crane arm segments extendable from and retractable into one another and the base body; a first mechanism coupling the power cylinder to the crane arm segments for extending the crane arm segments as a unit from the base body when the power cylinder moves from a retracted position into an extended position relative to the base body; and a second mechanism coupling the power cylinder to the crane arm segments for extending the crane arm segments relative to one another when the power cylinder moves from an extended position into a retracted position relative to the base body.

9 Claims, 6 Drawing Sheets

TELESCOPING CRANE ARM

CROSS REFERENCE TO RELATED APPLICATION

This application claims the priority of German Application No. P 43 11 964.6 filed Apr. 10, 1993, which is incorporated herein by reference.

BACKGROUND OF THE INVENTION

This invention relates to a telescoping crane arm having a base body and a plurality of nested telescoping arm segments which may be extended from the base body by means of a hydromechanical telescoping drive.

Telescoping crane arms of the above-outlined type are known in various constructions. The crane arm is, as a rule, telescoped either by means of a fully hydraulic device or in combination with cables. In the latter case, a telescoping arm segment is moved by means of a cable in synchronism and in the same direction as a hydraulically operated telescoping arm segment. For example, there has been suggested a hydromechanical telescoping system which has a base body and a plurality of telescoping arm segments which may be extended from the base body and a multi-stage hydraulic cylinder arrangement in which by means of an extending and retracting cable the base body and the first and second telescoping arm segments as well as the second to fourth telescoping arm segments are kinematically connected to one another such that the first and second and, respectively, the third and fourth telescoping arm segments are extendable in synchronism.

SUMMARY OF THE INVENTION

It is an object of the invention to provide an improved telescoping crane arm in which the stroke of a hydraulic telescoping drive is utilized in the one direction for directly extending a telescoping arm segment, while the stroke of the drive in the other direction is utilized for indirectly extending an additional telescoping arm segment by means of a cable after the first segment has been immobilized (locked).

This object and others to become apparent as the specification progresses, are accomplished by the invention, according to which, briefly stated, the telescoping crane arm assembly includes a base body; a power cylinder extendable from and retractable into the base body; a plurality of crane arm segments extendable from and retractable into one another and the base body; a first mechanism coupling the power cylinder to the crane arm segments for extending the crane arm segments as a unit from the base body when the power cylinder moves from a retracted position into an extended position relative to the base body; and a second mechanism coupling the power cylinder to the crane arm segments for extending the crane arm segments relative to one another when the power cylinder moves from an extended position into a retracted position relative to the base body.

After releasing the extended telescoping arm segment from the power member (piston) of the telescoping cylinder at the end of its forward stroke and after immobilizing the extended telescoping arm segment (for example, by locking it to the base body), the reverse stroke of the telescoping cylinder is utilized for extending a second telescoping arm segment so that the telescoping cylinder, after extending the second telescoping arm segment relatively to the first arm segment, is again in its original retracted position. By virtue of this arrangement, under the same operating conditions, as compared to conventional telescoping systems, greater loads may be lifted and/or longer extensions may be achieved. Essentially, in the structure according to the invention no changes are introduced as concerns the weight distribution so that no disadvantages are involved with the described advantages; rather, the total weight of the crane arm is reduced.

In a simplest application of the invention, the telescoping crane arm has two telescoping arm segments and a single-stage telescoping drive (hydraulic cylinder). For greater dimensions the telescoping crane arm is provided with three telescoping arm segments and a two-stage telescoping drive directly actuating the first and second telescoping arm segments. In such a case the extending cable and the retracting cable for the third telescoping arm segment are supported on the second movable telescoping cylinder.

According to another embodiment of the invention, there is provided a telescoping crane arm with four arm segments and a two-stage telescoping drive. In this embodiment there are provided a first extending cable and a first retracting cable supported on the second movable telescoping cylinder and serving the third telescoping segment and a second extending cable and a second retracting cable supported on the second telescoping segment and guided over deflecting rollers supported on the third telescoping segment and serving the fourth telescoping segment.

It is furthermore feasible to utilize an even greater number of telescoping arm segments according to the invention.

According to the invention, locking means are provided between the movable telescoping cylinders and the base body and the telescoping arm segments as well as between the telescoping arm segments themselves and the base body for immobilizing components also in intermediate positions. With this arrangement, an operation according to the invention with improved effect can be achieved. Thus, the load and bending torque distribution during the extending steps and the load conditions after extension are improved not only for the end positions, but for intermediate positions as well.

DESCRIPTION OF THE PREFERRED EMBODIMENTS

Figure 1A:
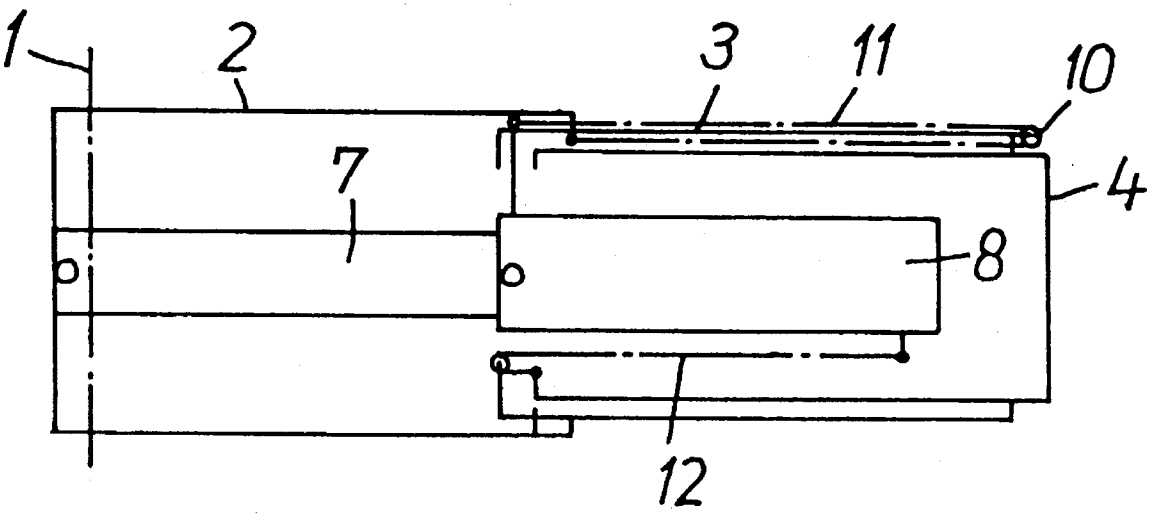
FIGS. 1*a*, 1*b* and 1*c* are schematic axial sectional views of three different operational positions of a preferred embodiment of a telescoping crane arm according to the invention, having two telescoping arm segments and a single-stage telescoping drive.

Referring first generally to all the four embodiments illustrated in the Figures, on a non-illustrated supporting structure, for example, a turning device supported on a chassis, a base body 2 is vertically pivotal about a horizontal base crane axis 1. In the base body 2 mutually nesting telescoping crane arm segments (such as 3 and 4 or 3, 4 and 5 or 3, 4, 5 and 6) are guided. The base body 2 further supports a one-stage or two-stage telescoping drive whose telescoping piston 7 is connected with the base body 2 and whose movable telescoping cylinder 8 is hydraulically movable with respect to the telescoping piston 7. In case of a two-stage embodiment of the telescoping drive, the second telescoping cylinder 9 is hydraulically movable with respect to the first telescoping cylinder 8. An extending cable 11 is secured to the rear portion of one telescoping drive and is guided by a deflecting roller 10 secured to the front portion of one arm segment to an attachment point at the rear portion of another arm segment. A retracting cable 12 is guided from the front portion of one telescoping cylinder about a deflecting roller 13 at the rear portion of one arm segment to the rear portion of another arm segment. By means of locking mechanisms at the telescoping cylinders and arm segments the latter may be held fixedly in desired positions.

Figure 1B:
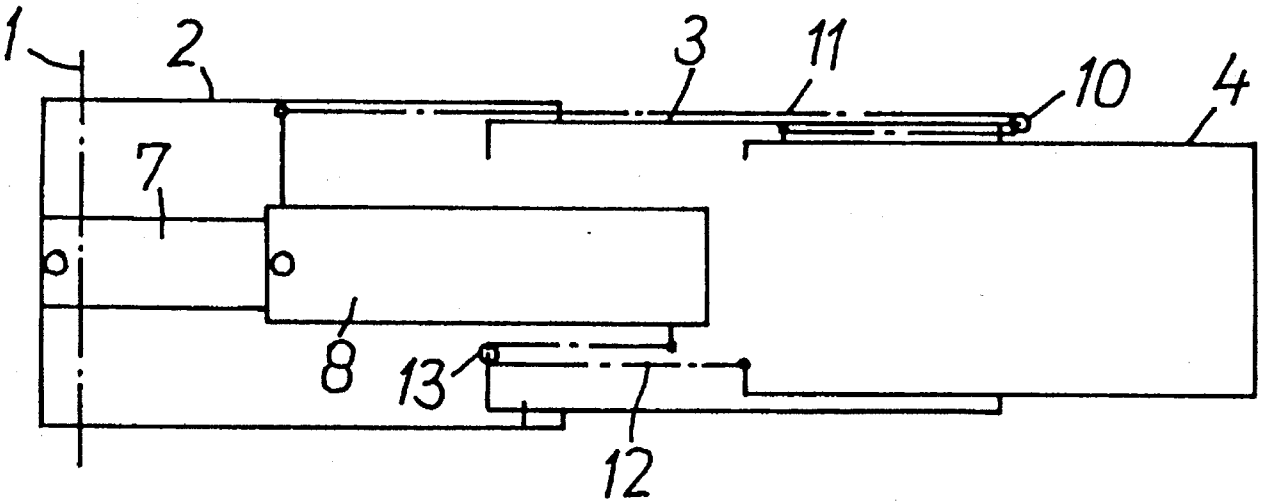
Figure 1C:
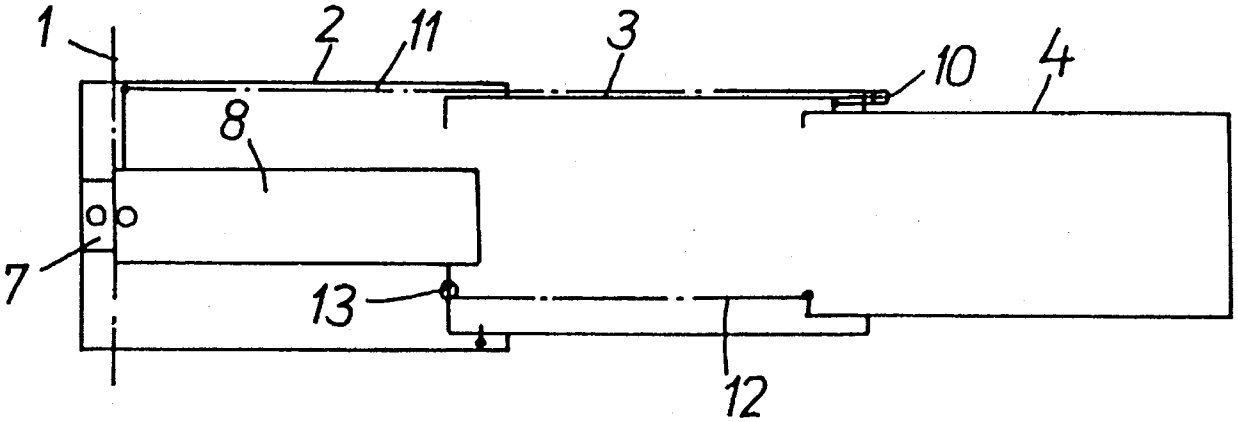

By virtue of the above-described mechanism, the positioning of the telescoping crane arm segments according to the embodiment illustrated in FIGS. 1*a*, 1*b* and 1*c* may be achieved. First, the arm segments 3 and 4 are in unison extended out of the base body 2 by expanding the telescoping cylinder 8 into the position shown in FIG. 1*a*. Thereafter the first telescoping arm segment 3 is immobilized and then the second telescoping arm segment 4 is further extended by means of the extending cable by retracting the telescoping cylinder 8. FIG. 1*b* shows the progress of such further extension of the second arm segment 4, whereas FIG. 1*c* illustrates the final extended position of the second arm segment 4. The retraction of the telescoping crane arm segments 3 and 4 is executed in a reverse order. In this embodiment a first crane arm segment 3 is slidably held in the base body 2 and a second crane arm segment 4 is slidably held in the first crane arm segment 3. An extending cable 11 is attached at one end to the rear portion of the power cylinder 8 and at another end to the rear portion of the second crane arm segment 4. The extending cable 11 is trained about a roller 10 which is attached to the front portion of the first crane arm segment 3. A retracting cable 12 is attached at one end to the front portion of the power cylinder 8 and, at its other end, to the rear portion of the second crane arm segment 4. The retracting cable 12 is trained about a roller 13 mounted on the rear portion of the first crane arm segment 3.

Figure 2C:
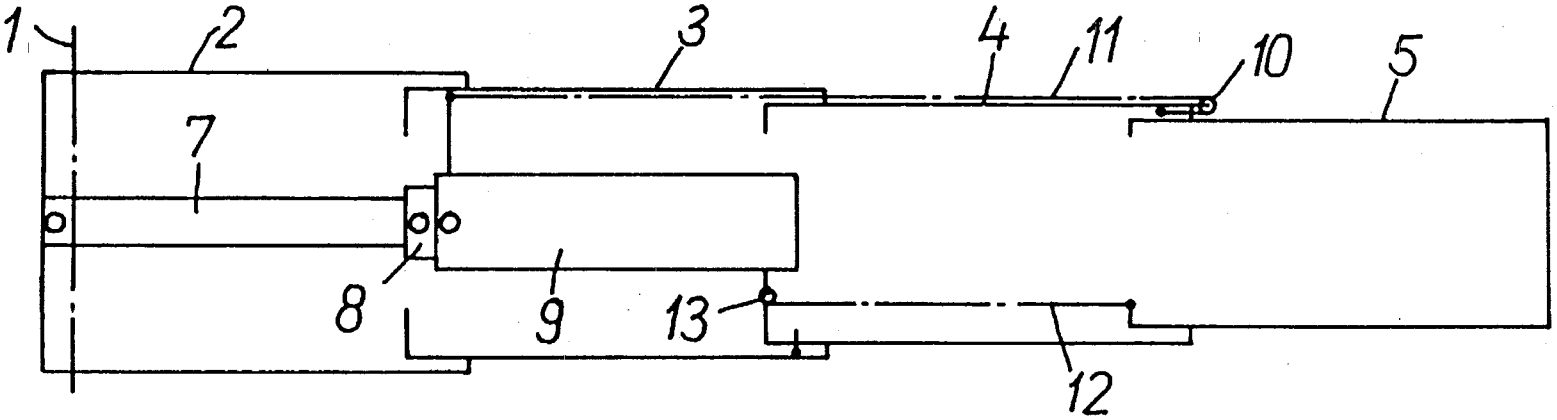
FIGS. 2*a*, 2*b* and 2*c* are schematic axial sectional views of three different operational positions of another preferred embodiment of the telescoping crane arm according to the invention, having three telescoping arm segments and a two-stage telescoping drive.
Figure 2A:
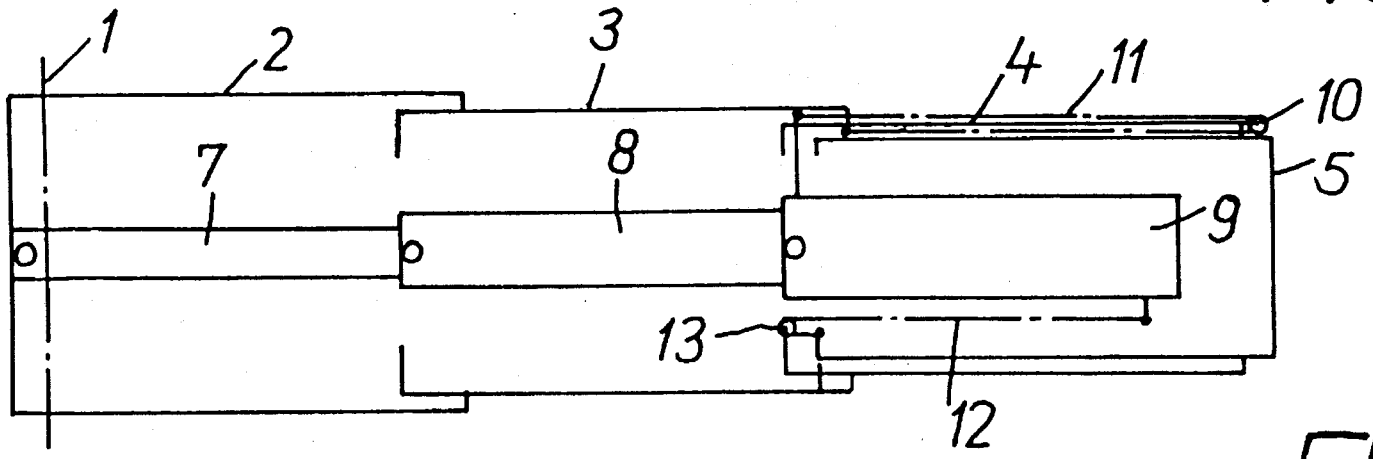
Figure 2B:
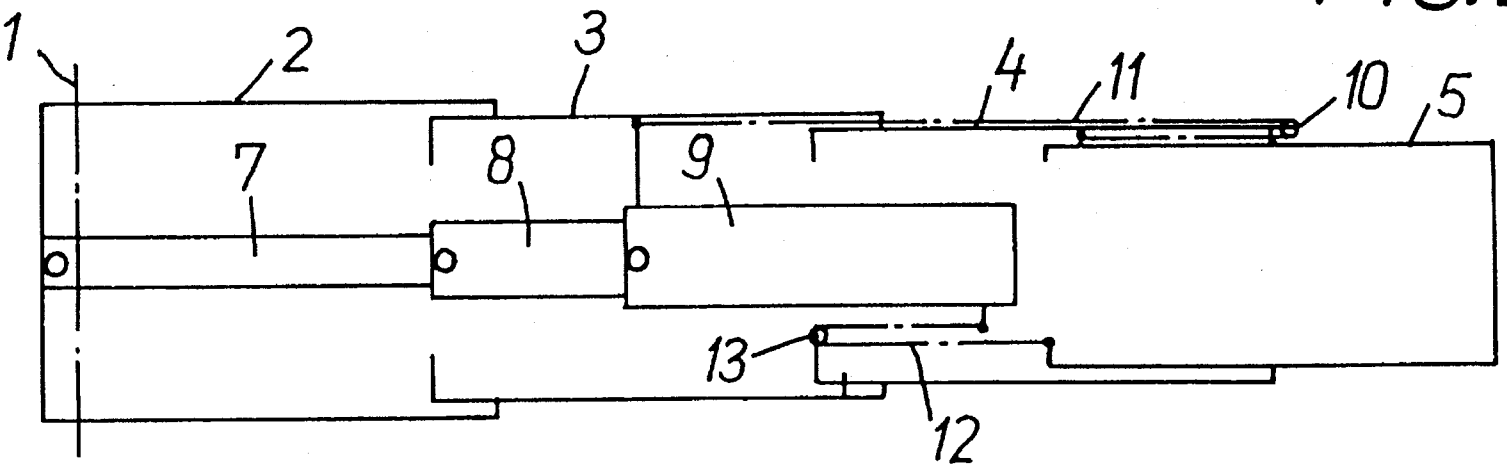

In case of a two-stage embodiment of the telescoping device and three telescoping crane segments as illustrated in FIGS. 2*a*, 2*b* and 2*c*, the telescoping crane segments 3 and 4 are consecutively or in a desired order extended by the telescoping cylinders 8 and 9 to assume the position shown in FIG. 2*a*. After extending the second telescoping crane arm segment 4 from the first telescoping crane arm segment 3 by extending the second telescoping cylinder 9 and by immobilizing the second telescoping crane arm segment 4 together with the first telescoping crane arm segment 3, the third telescoping crane segment 5 is extended by imparting thereto the pulling force of the extending cable 11 by retracting the second telescoping cylinder 9. An intermediate position during this process is shown in FIG. 2*b*, while FIG. 2*c* shows the fully extended state of the third arm segment 5. In this embodiment a second power cylinder 9 is slidably movable relative to a first power cylinder 8. A first crane arm segment 3 is slidably supported in the base body 2, a second crane arm segment 4 is slidably supported in the first crane arm segment 3 and a third crane arm segment 5 is slidably supported in the second crane arm segment 4. An extending cable 11 has one end attached to the rear portion of the second power cylinder 9 and another end attached to the rear portion of the third crane arm segment 5. The extending cable 11 is trained about a roller 10 mounted on the front portion of the second crane arm segment 4. A retracting cable 12 is attached to the front portion of the second power cylinder 9 and, at its opposite end, to the rear portion of the third crane arm segment 5. The retracting cable 12 is trained about a roller 13 mounted on the rear portion of the second crane arm segment 4.

Figure 3A:
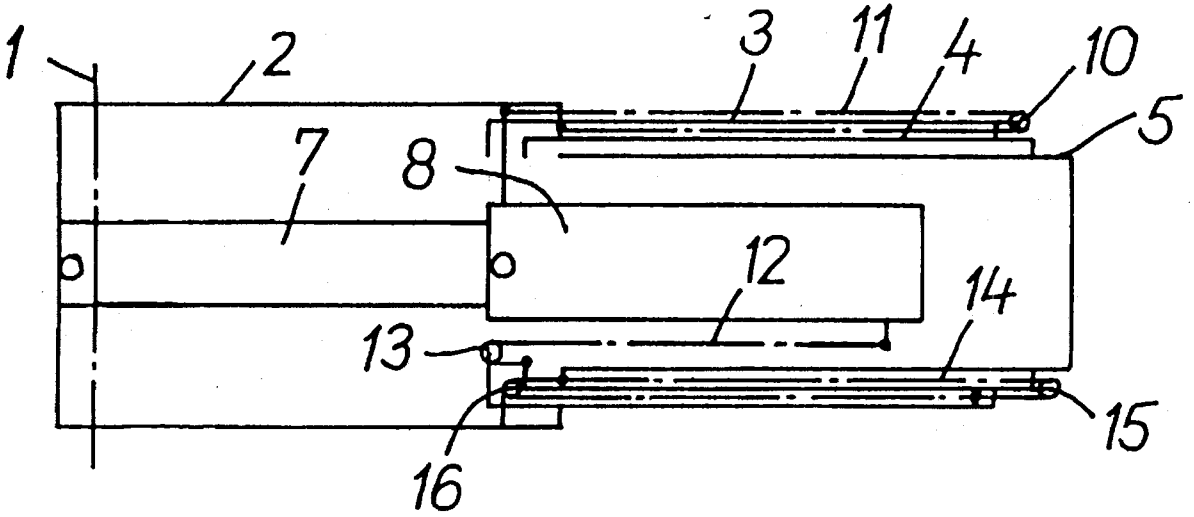
FIGS. 3*a*, 3*b* and 3*c* are schematic axial sectional views of three different operational positions of still another preferred embodiment of the telescoping crane arm according to the invention, having three telescoping arm segments and a one-stage telescoping drive.
Figure 3B:
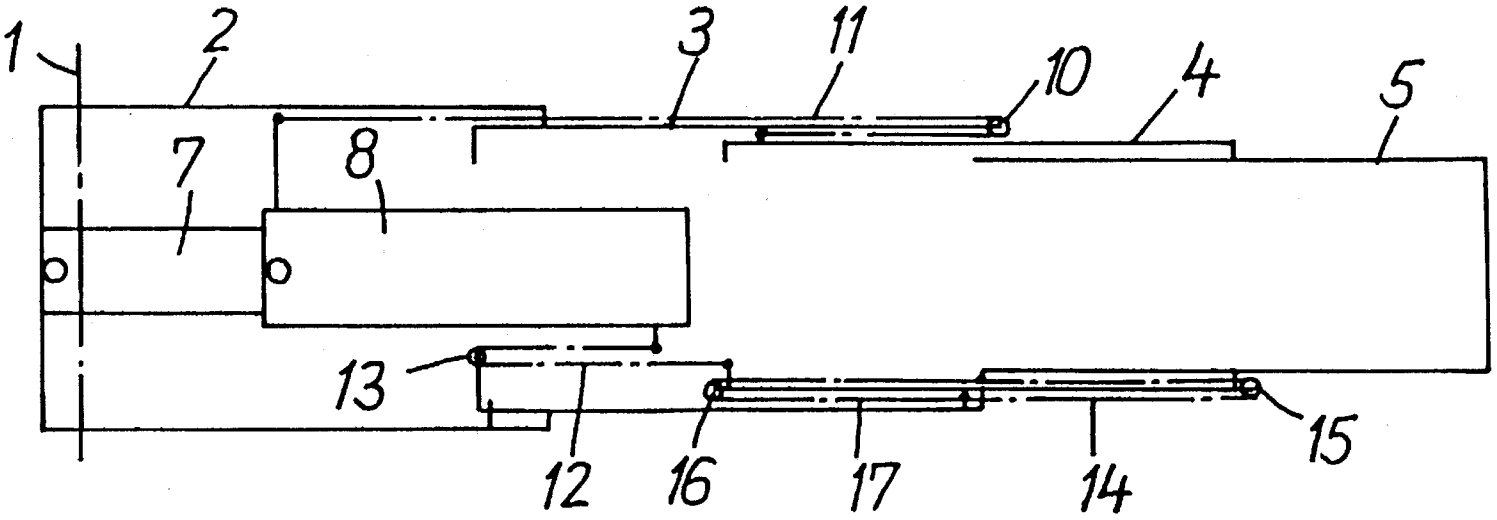
Figure 3C:
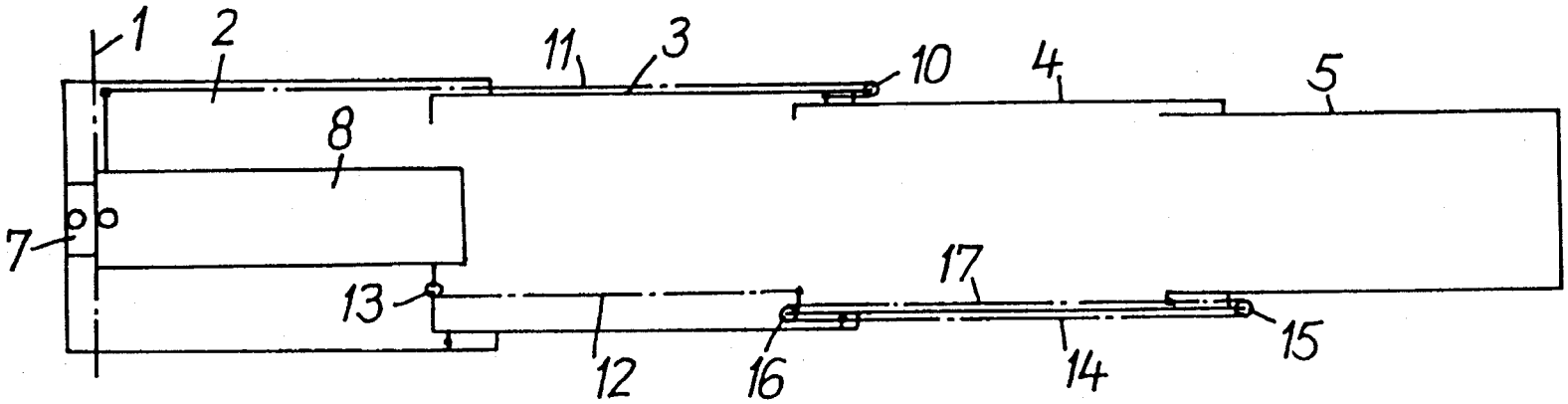

FIGS. 3*a*, 3*b* and 3*c* illustrate a single-stage, three-segment embodiment. First the three arm segments are simultaneously extended by extending the cylinder 8 (FIG. 3*a*). Thereafter, the first arm segment 3 is locked and the cylinder 8 retracted, whereby the second and third telescoping arm segments 4 and 5 are simultaneously extended by means of the first and a second extending cable 11 and 14. The extending cable 14 is guided over a deflecting roller 15 at the front portion of the second telescoping arm segment 4 and is associated with a retracting cable 17 guided over a deflecting roller 16 at the rear portion of the second telescoping crane arm segment 4. Intermediate and final extended positions are shown in FIGS. 3*b* and 3*c*, respectively. In this embodiment first, second and third crane arm segments 3, 4 and 5 are telescopingly nested in one another. A first extending cable 11 is attached at one end to the rear portion of the power cylinder 8 and at its other to the rear portion of the second crane arm segment 4. The first extending cable 11 is trained about a roller 10 mounted on the front portion of the first crane arm segment 3. A second extending cable 14 is attached at one end to the front portion of the first crane arm segment 3 and at its other end to the rear portion of the third crane arm segment 5. The second extending cable 14 is trained about a roller 15 mounted on the front portion of the second crane arm segment 4. A first retracting cable 12 is attached at one end to the front portion of the power cylinder 8 and at its other end to the rear portion of the second crane arm segment 4. The first retracting cable 12 is trained about a roller 13 attached to the rear portion of the first crane arm segment 3. A second retracting cable 17 is attached at one end to the front portion of the first crane arm segment 3 and at its other end to the rear portion of the third crane arm segment 5. The second retracting cable 17 is trained about a roller 16 attached to the rear portion of the second crane arm segment 4.

Figure 4C:
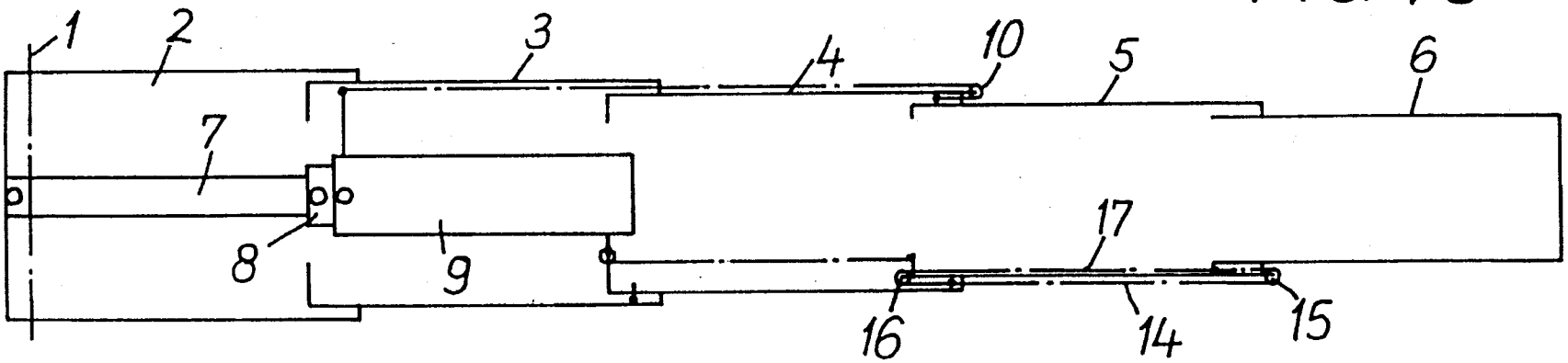
FIGS. 4*a*, 4*b* and 4*c* are schematic axial sectional views of three different operational positions of still another embodiment of the telescoping crane arm having four telescoping arm segments and a two-stage telescoping drive.
Figure 4A:
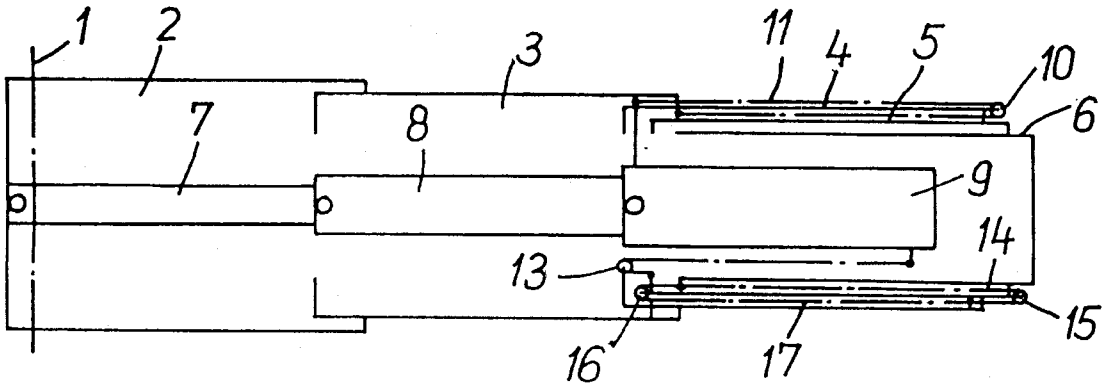
Figure 4B:
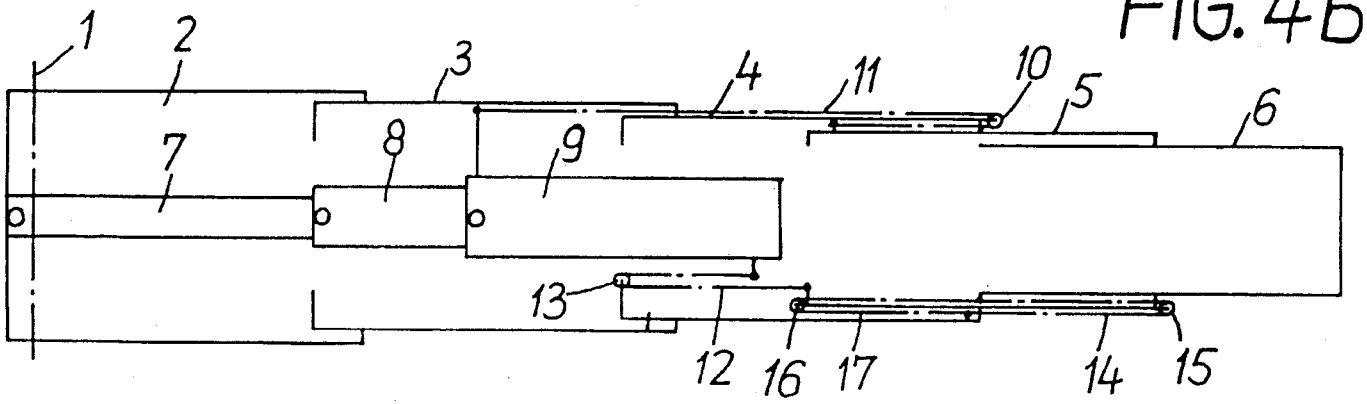

The embodiment illustrated in FIGS. 4*a*, 4*b* and 4*c* is adapted for a crane arm with four telescoping crane arm segments operated by a two-stage telescoping drive. In this embodiment, first the two cylinders 8 and 9 are extended (simultaneously or in any sequence). The cylinder 8 carries the arm segment 3 and the cylinder 9 carries the arm segments 4, 5 and 6 into the position shown in FIG. 4*a*. Thereafter the second arm segment 4 is locked and the cylinder 9 is retracted, whereby the third and fourth arm segments 5 and 6 are simultaneously extended by the first and second telescoping cables 11 and 14. Thus, in this embodiment, first and second power cylinders 8 and 9 are used which extend and retract four nested crane arm segments 3, 4, 5 and 6. A first extending cable 11 is, at one of its ends, attached to the rear portion of the second power cylinder 9 and, at its other end is attached to the rear portion of the third crane arm segment 5. The first extending cable 11 is trained about a roller 10 mounted on the front portion of the second crane arm segment 4. A second extending cable 14 is attached at one of its ends to the front portion of the second crane arm segment 4 and, at its other end, to the rear portion of the fourth crane arm segment 6. The second extending cable 14 is trained about a roller 15 mounted on the front portion of the third crane arm segment 5. A first retracting cable 12 is, at one end, attached to the front portion of the second power cylinder 9 and, at its other end, to the rear portion of the third crane arm segment 5. The first retracting cable 12 is trained about a roller 13 mounted on the rear portion of the second crane arm segment 4. A second retracting cable 17 is attached at one end to the front portion of the second crane arm segment 4 and at the other to the rear portion of the fourth crane arm segment 6. The second retracting cable 17 is trained about a roller 16 mounted on the rear portion of the third crane arm segment 5.

Figure 5:
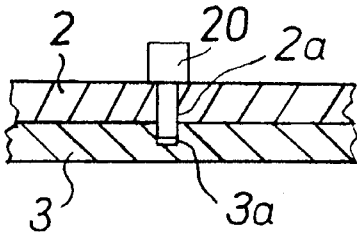
FIG. 5 is a fragmentary sectional view of two components and a mechanism releasably locking the components to one another.

The required immobilization and release of various components which are relatively movable to one another may be effected by a simple conventional locking mechanism, for example, a sufficiently sturdy pin manually insertable or removable from holes which are provided in the relatively movable components and which are in alignment with one another in the desired relative position where immobilization of the component is required. FIG. 5 illustrates, as an example, a locking between the base body 2 and the arm segment 3 after the position shown in FIG. 1*a* is attained but before retraction of the cylinder 8 (to extend the arm segment 4) is commenced. Thus, in the FIG. 1*a* position a hole 2*a* provided in the base body 2 is in alignment with a hole 3*a* (which may be a blind bore) of the arm segment 3, and by inserting a pin 20 to pass through the holes 2*a* and 3*a*, the arm segment 3 is locked to the base body 2, whereby immobilization of the arm segment 3 is achieved.

Such a locking mechanism may also be provided between the arm segments as well as between an arm segment and the moving cylinder which displaces the arm segment. Preferably, such a locking should be feasible in the respective end positions of the relatively movable components but advantageously some or all components may carry a series of axially spaced holes to ensure that components may be locked to one another and thus immobilized in desired intermediate positions.

It will be understood that the above description of the present invention is susceptible to various modifications, changes and adaptations, and the same are intended to be comprehended within the meaning and range of equivalents of the appended claims.

What is claimed is:

1. A telescoping crane arm assembly comprising (a) a base body;

(b) a power cylinder extendable from and retractable into said base body;

(c) a plurality of crane arm segments extendable from and retractable into one another and said base body;

(d) first means coupling said power cylinder to said crane arm segments for extending said crane arm segments as a unit from said base body when said power cylinder moves from a retracted position into an extended position relative to said base body; and (e) second means coupling said power cylinder to said crane arm segments for extending said crane arm segments relative to one another when said power cylinder moves from an extended position into a retracted position relative to said base body.

2. A telescoping crane arm assembly as defined in claim 1, wherein said first means includes releasable locking means for locking said crane arm segments to said power cylinder.

3. A telescoping crane arm assembly as defined in claim 1, wherein said second means includes releasable locking means for locking one of said crane arm segments to said power cylinder in said extended position of said power cylinder and an extending cable having a first end attached to said power cylinder and a second end attached to a first of said crane arm segments; said extending cable being guided on a second of said crane arm segments.

4. A telescoping crane arm assembly as defined in claim 3, wherein said releasable locking means includes means for releasably and selectively locking said crane arm segments to one another, to said power cylinder and to said base body in selected intermediate positions of said crane arm segments and said power cylinder between extended and retracted end positions of said power cylinder and said crane arm segments.

5. A telescoping crane arm assembly comprising (a) a base body;

(b) a power cylinder supported in said base body and being extendable from and retractable into said base body;

(c) a first crane arm segment supported in said base body and being extendable and retractable therefrom;

(d) a second crane arm segment supported in said first crane arm segment and being extendable and retractable therefrom; said first and second crane arm segments and said power cylinder each having a rear portion oriented toward a direction of retraction of the segments and a front portion oriented toward a direction of extension of the segments;

(e) a first deflecting roller mounted on the front portion of said first crane arm segment;

(f) an extending cable having a first end affixed to the rear portion of said power cylinder and a second end affixed to the rear portion of said second crane arm segment; said extending cable being trained about said first deflecting roller;

(g) a second deflecting roller mounted on the rear portion of said first crane arm segment;

(h) a retracting cable having a first end affixed to the front portion of said power cylinder and a second end affixed to the rear portion of said second crane arm segment; said retracting cable being trained about said second deflecting roller; and (i) selectively applicable and releasable locking means for selectively locking one of said crane arm segments to said power cylinder, said first crane arm segment to said base body and said first crane arm segment to said second crane arm segment.

6. A telescoping crane arm assembly comprising (a) a base body;

(b) a first power cylinder supported in said base body and being extendable from and retractable into said base body;

(c) a second power cylinder supported by said first power cylinder and being extendable and retractable relative to said first power cylinder;

(d) a first crane arm segment supported in said base body and being extendable therefrom and retractable thereinto;

(e) a second crane arm segment supported in said first crane arm segment and being extendable therefrom and retractable thereinto;

(f) a third crane arm segment supported in said second crane arm segment and being extendable therefrom and retractable thereinto; said first, second and third crane arm segments and said first and second power cylinders each having a rear portion oriented toward a direction of retraction of the segments and a front portion oriented toward a direction of extension of the segments;

(g) a first deflecting roller mounted on the front portion of said second crane arm segment;

(h) an extending cable having a first end affixed to the rear portion of said second power cylinder and a second end affixed to the rear portion of said third crane arm segment; said extending cable being trained about said first deflecting roller;

(i) a second deflecting roller mounted on the rear portion of said second crane arm segment;

(j) a retracting cable having a first end affixed to the front portion of said second power cylinder and a second end affixed to the rear portion of said third crane arm segment; said retracting cable being trained about said second deflecting roller; and (k) selectively applicable and releasable locking means for selectively locking one of said crane arm segments to said second power cylinder, said first crane arm segment to said base body and said crane arm segments to one another.

7. A telescoping crane arm assembly comprising (a) a base body;

(b) a power cylinder supported in said base body and being extendable from and retractable into said base body;

(c) a first crane arm segment supported in said base body and being extendable therefrom and retractable thereinto;

(d) a second crane arm segment supported in said first crane arm segment and being extendable therefrom and retractable thereinto;

(e) a third crane arm segment supported in said second crane arm segment and being extendable therefrom and retractable thereinto; said first, second and third crane arm segments and said power cylinder each having a rear portion oriented toward a direction of retraction of the segments and a front portion oriented toward a direction of extension of the segments;

(f) a first deflecting roller mounted on the front portion of said first crane arm segment;

(g) a first extending cable having a first end affixed to the rear portion of said power cylinder and a second end affixed to the rear portion of said second crane arm segment; said first extending cable being trained about said first deflecting roller;

(h) a second deflecting roller mounted on the front portion of said second arm segment;

(i) a second extending cable having a first end affixed to the front portion of said first crane arm segment and a second end affixed to the rear portion of said third crane arm segment; said second extending cable being trained about said second deflecting roller;

(j) a third deflecting roller mounted on the rear portion of said first crane arm segment;

(k) a first retracting cable having a first end affixed to the front portion of said power cylinder and a second end affixed to the rear portion of said second crane arm segment; said first retracting cable being trained about said third deflecting roller;

(l) a fourth deflecting roller mounted on the rear portion of said second arm segment;

(m) a second retracting cable having a first end affixed to the front portion of said first crane arm segment and a second end affixed to the rear portion of said third crane arm segment; said second retracting cable being trained about said fourth deflecting roller; and (n) selectively applicable and releasable locking means for selectively locking one of said crane arm segments to said power cylinder, said first crane arm segment to said base body and said crane arm segments to one another.

8. A telescoping crane arm assembly comprising (a) a base body;

(b) a first power cylinder supported in said base body and being extendable from and retractable into said base body;

(c) a second power cylinder supported in said first power cylinder and being extendable and retractable relative to said first power cylinder;

(d) a first crane arm segment supported in said base body and being extendable therefrom and retractable thereinto;

(e) a second crane arm segment supported in said first crane arm segment and being extendable therefrom and retractable thereinto;

(f) a third crane arm segment supported in said second crane arm segment and being extendable therefrom and retractable thereinto;

(g) a fourth crane arm segment supported in said third crane arm segment and being extendable therefrom and retractable thereinto; said first, second, third and fourth crane arm segments and said first and second power cylinder each having a rear portion oriented toward a direction of retraction of the segments and a front portion oriented toward a direction of extension of the segments;

(h) a first deflecting roller mounted on the front portion of said second crane arm segment;

(i) a first extending cable having a first end affixed to the rear portion of said second power cylinder and a second end affixed to the rear portion of said third crane arm segment; said first extending cable being trained about said first deflecting roller;

(j) a second deflecting roller mounted on the front portion of said third crane arm segment;

(k) a second extending cable having a first end affixed to the front portion of said second crane arm segment and a second end affixed to the rear portion of said fourth crane arm segment; said second extending cable being trained about said second deflecting roller;

(l) a third deflecting roller mounted on the rear portion of said second crane arm segment;

(m) a first retracting cable having a first end affixed to the front portion of said second power cylinder and a second end affixed to the rear portion of said third crane arm segment; said first retracting cable being trained about said third deflecting roller;

(n) a fourth deflecting roller mounted on the rear portion of said third crane arm segment;

(o) a second retracting cable having a first end attached to the front portion of said second crane arm segment and a second end affixed to the rear portion of said fourth crane arm segment; said second retracting cable being trained about said fourth deflecting roller; and (p) selectively applicable and releasable locking means for selectively locking one of said crane arm segments to said second power cylinder, said first crane arm segment to said base body and said crane arm segments to one another.

9. A telescoping crane arm assembly comprising (a) a base body;

(b) a power cylinder extendable from and retractable into said base body;

(c) a plurality of crane arm segments extendable from and retractable into one another and said base body;

(d) releasable locking means having a first state for locking said crane segments to said power cylinder to immobilize said crane arm segments relative to one another and said power cylinder, whereby said crane arm segments move as a unit together with said power cylinder upon displacement of said power cylinder and a second state for releasing a first and a second of said crane arm segments from one another and from said power cylinder, whereby said first and second crane arm segments are movable relative to one another and said power cylinder upon displacement of said power cylinder;

(e) extending cable means for extending said first and second crane arm segments relative to one another when said releasable locking means is in said second state and said power cylinder is moved from an extended position to a retracted position; and (f) retracting cable means for retracting said first and second crane arm segments relative to one another when said releasable locking means is in said second state and said power cylinder is moved from a retracted position to an extended position, whereby a power cylinder displacement composed of an extension and an ensuing retraction of said power cylinder relative to said base body effects two consecutive, extending displacements of said second arm crane segment relative to said base body and whereby a power cylinder displacement composed of a retraction and an ensuing extension of said power cylinder relative to said base body effects two consecutive, retracting displacements of said second crane arm segment relative to said base body.

* * * * *